US009105393B2

(12) United States Patent
Takahashi et al.

(10) Patent No.: US 9,105,393 B2
(45) Date of Patent: Aug. 11, 2015

(54) AMORPHOUS CORE TRANSFORMER

(75) Inventors: Toshiaki Takahashi, Tainai (JP); Hiroyuki Endo, Agano (JP); Ryosuke Mikoshiba, Shibata (JP); Tatsunori Sato, Tainai (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 13/605,549

(22) Filed: Sep. 6, 2012

(65) Prior Publication Data

US 2013/0106547 A1 May 2, 2013

(30) Foreign Application Priority Data

Nov. 1, 2011 (JP) ..... 2011-239852
Nov. 10, 2011 (JP) ..... 2011-246660

(51) Int. Cl.

| | |
|---|---|
| ***H01F 27/26*** | (2006.01) |
| ***H01F 27/28*** | (2006.01) |
| ***H01F 27/30*** | (2006.01) |
| ***H01F 27/06*** | (2006.01) |
| ***H01F 27/25*** | (2006.01) |

(52) U.S. Cl.

CPC ..... *H01F 27/306* (2013.01); *H01F 27/25* (2013.01)

(58) Field of Classification Search

CPC ..... H01F 27/25; H01F 27/306; H01F 27/26; H01F 27/266; H01F 27/263; H01F 3/04; H01F 30/12

USPC ..... 336/60, 184, 5, 128, 145, 170, 182, 336/185, 179, 208, 212, 210, 196–198

See application file for complete search history.

(56) References Cited

U.S. PATENT DOCUMENTS

| | | | | |
|---|---|---|---|---|
| 3,750,070 | A * | 7/1973 | Rissinger | 336/84 R |
| 3,789,337 | A * | 1/1974 | Sheppard | 336/60 |
| 3,792,395 | A * | 2/1974 | Michel | 336/5 |
| 3,810,058 | A * | 5/1974 | White et al. | 336/196 |

(Continued)

FOREIGN PATENT DOCUMENTS

| | | |
|---|---|---|
| DE | 24 30 035 A1 | 1/1976 |
| JP | 51-5521 A | 1/1976 |

(Continued)

OTHER PUBLICATIONS

Partial European Search Report dated Nov. 8, 2012 (five (5) pages).

(Continued)

*Primary Examiner* — Mangtin Lian
(74) *Attorney, Agent, or Firm* — Crowell & Moring LLP

(57) ABSTRACT

An amorphous core transformer is provided which is capable of effectively suppressing influences, fluctuation, displacement or the like of a coil caused by an electromagnetic mechanical force or the like. In an amorphous core transformer 100 including an amorphous core 101, a plurality of coils 102 in which the amorphous core 101 is inserted and a fixing metal frame 110 that assembles the coils 102 and the amorphous core 101, the inter-coil member 106 is interposed between the neighboring coils 102 and the inter-coil member 106 is positioned and held by a positioning member 107. Thus, it is possible to prevent the coils 102 from being deformed or displaced beyond the inter-coil member 106 and maintain the shape of the coils 102.

7 Claims, 9 Drawing Sheets

(56) References Cited

U.S. PATENT DOCUMENTS

| | | | | |
|---|---|---|---|---|
| 4,135,172 | A * | 1/1979 | Grimes | 336/197 |
| 4,345,232 | A * | 8/1982 | DeLaurentis | 336/210 |
| 4,839,622 | A * | 6/1989 | Hay | 336/92 |
| 5,331,304 | A | 7/1994 | White et al. | |
| 6,424,246 | B1 * | 7/2002 | Kysely et al. | 336/90 |
| 2002/0057180 | A1 * | 5/2002 | Shirahata et al. | 336/213 |
| 2006/0250205 | A1 * | 11/2006 | De et al. | 336/65 |
| 2011/0234360 | A1 | 9/2011 | Nakanoue et al. | |

FOREIGN PATENT DOCUMENTS

| | | | |
|---|---|---|---|
| JP | 51-53409 | U | 4/1976 |
| JP | 54-95831 | U | 7/1979 |
| JP | 54-126015 | U | 9/1979 |
| JP | 55-16419 | A | 2/1980 |
| JP | 56-143832 | U | 10/1981 |
| JP | 3-3719 | U | 1/1991 |
| JP | 03-286506 | A * | 12/1991 |
| JP | 4-2103 | A | 1/1992 |
| JP | 4-18405 | U | 2/1992 |
| JP | 8-222458 | A | 8/1996 |
| JP | 10-340815 | A | 12/1998 |
| JP | 3063645 | U | 8/1999 |
| JP | 2010-118384 | A | 5/2010 |

OTHER PUBLICATIONS

European Search Report dated Apr. 3, 2014 (Eleven (11) pages).
Japanese Office Action dated Nov. 11, 2014 issued in corresponding Japanese Patent Application No. 2011-246660 (two pages).
Japanese Office Action dated Nov. 11, 2014 issued in corresponding Japanese Patent Application No. 2011-239852 (two pages).

* cited by examiner (A)

(B)

AMORPHOUS CORE TRANSFORMER

The present application is based on and claims priorities of Japanese patent application No. 2011-239852 filed on Nov. 1, 2011 and Japanese patent application No. 2011-246660 filed on Nov. 10, 2011, the entire contents of which are hereby incorporated by reference.

BACKGROUND OF THE INVENTION

1. Field of the Invention

The present invention relates to a transformer provided with an amorphous core and a plurality of coils in which the amorphous core is inserted, and more particularly, to a coil structure thereof.

2. Description of the Related Art

Transformers are generally known to vibrate by an electromagnetic mechanical force at the time of short circuit in such a way that an inner coil and an outer coil of their own coil repel each other. As such effects, for example, a bobbin may be buckled to the inside or a gap may be produced between the inner coil and the outer coil. Thus, occurrence of fluctuation, displacement or the like as effects of the electromagnetic mechanical force on the coil is pointed out as problems with transformers. Furthermore, in the case of a three-phase coil or the like, this coil vibration varies with time due to a phase difference (e.g., 120 degrees) between coils, and therefore the coils are known to influence each other. The time difference or phase difference in vibration between the coils causes an unpredicted force to be applied to windings of the coils and it is necessary to consider effects of the unpredicted force on the transformer itself.

Japanese Patent Laid-Open Publication No. 10-340815 (Patent Document 1) describes a related art in this technical field. Referring to an amorphous core transformer provided with an amorphous core wound with amorphous thin magnetic ribbons in multiple layers and a plurality of coils, this document points out as problems to be solved how to secure buckling strength for an inner coil and an outer coil that constitute the coil, how not to press the amorphous core and how not to deteriorate iron loss or excitation current. As a solution, the document discloses that a coil drum made up of a plurality of drum members arranged in a width direction of the core member is provided on the innermost circumference of at least one coil and the outermost amorphous core includes a strengthened frame that surrounds the core and presses the outside of the coil in which the core is inserted.

Another related art is Japanese Patent Laid-Open Publication No. 2010-118384 (Patent Document 2). The art described in this document provides a coil drum for a transformer and a transformer using the same that have as an object to secure buckling strength of an inner winding of a coil of the transformer and prevent pressure on its core, and do not deteriorate iron loss or excitation current. As a solution, the core is made up of a wound core which is wound with magnetic ribbons in multiple layers or cores stacked in multiple layers and the coil is inserted in the core. The coil drum arranged on the innermost circumference of the coil is formed into an arc shape outside, thus improving strength against buckling recessed toward the inside which is the core side. Therefore, the document describes that buckling strength with respect to the inner winding is secured, and the core is never pressed or iron loss or excitation current does not deteriorate either even in the case of a large-volume transformer.

A further related art is Japanese Utility Model Laid-Open Publication No. 54-126015 (Patent Document 3). This document relates to a static induction electric apparatus, and more particularly, to a core of a transformer or reactor and a winding tightening device. As a solution, the document describes a core of a transformer and a winding tightening device for a static induction electric apparatus including a core and a winding wound around the core together with an insulating medium accommodated in a tank, wherein a high strength inter-phase insulating member inserted between phases of windings and a seat provided on a tightening metal that sandwiches the insulating member and a core yoke are engaged with each other and secured via a tightening member to thereby tighten the core yoke and the winding together.

A still further related art is Japanese Patent Laid-Open Publication No. 55-16419 (Patent Document 4). This document relates to a core-type transformer including, for example, a winding having a square cross section. As a solution, the document describes a core-type transformer including a core, a winding wound around the core and an external box that accommodates a winding section, wherein the periphery of the winding is supported by the external box via an insulating section.

A still further related art is Japanese Utility Model Laid-Open Publication No. 3-3719 (Patent Document 5). This document relates to an electromagnetic inductive winding structure used for a transformer or other electromagnetic inductive apparatuses. As a solution, the document describes an electromagnetic inductive apparatus in which outer circumferences of windings of different phases arranged in parallel via an inter-phase spacer are collectively secured using an insulating fixing band.

Furthermore, a still further related art is Japanese Patent Laid-Open Publication No. 8-222458 (Patent Document 6). This document relates to a reactor, transformer or the like designed to reduce noise and/or vibration and reduce the size and/or weight. As a solution, the document describes a reactor transformer including a core and a plurality of coils, wherein the core and the coils are fixed together, and further the coils are fixed together so as to suppress vibration of the core.

Furthermore, a still further related art is Utility Model Registration Publication No. 3063645 (Patent Document 7). This document relates to provision of a central body fixing structure of a transformer that reduces damage of an amorphous core. As a solution, the document describes a central body fixing structure of a transformer in which insulating piece/insulating plate structures are provided at a top end and a bottom end inside a coil, the insulating plates are arranged so as to interlace with each other, cover an outer edge of the amorphous core in a ring shape and protrude relatively high, the insulating plates are sandwiched between the coil and a case so that the amorphous core wound with the coil is also indirectly positioned therein without requiring any holding force of the coil and the case to fix the amorphous core and thus preventing damage to the amorphous core.

Transformers are apparatuses that convert high-voltage and low-current AC power to low-voltage and high-current AC power or vice versa, and are provided with a core that constitutes a magnetic circuit and a coil that constitutes an electric circuit. FIG. 9(A) shows a cross-sectional view of a coil 803 of a conventional amorphous core transformer. When manufacturing a transformer using an amorphous core 802, since amorphous ribbons are very thin and difficult to mold, it is a general practice that amorphous ribbons of the same width are stacked on one another in a core shape. For this reason, the cross-sectional shape of the amorphous core 802 is a substantially rectangular shape, and since a rectangular bobbin 805 is used accordingly, gaps 810 are produced in rectilinear parts between an inner coil 807 and the rectangular bobbin 805 during a winding operation. Thus, the coil size becomes greater than its design value, making assembly impossible, or in a short circuit test conducted after completion of assembly of the transformer, an electromagnetic mechanical force produced at the time of short circuit causes repulsion between the inner coil 807 and an outer coil 808, an electric wire drops into the gaps 810 between the inner coil 807 and the rectangular bobbin 805, thus producing gaps 811 between the inner coil 807 and the outer coil 808 and increasing short circuit impedance (FIG. 9(B)).

Pressing the amorphous core and imposing load on the amorphous core deteriorate no load loss. This may cause transformers to fail to satisfy their standard values and fail to pass a model test or the like. Due to these problems, it is particularly difficult to manufacture a large-volume model whose electromagnetic mechanical force increases at the time of short circuit. The electromagnetic mechanical force of a coil refers to a force acting in accordance with the law that different electric wires through which currents pass in the same direction at the time of short circuit attract each other and electric wires through which currents pass in opposite directions repel each other.

The related arts provide a press process to reduce these gaps and determine the size of the coil, which may result in an increase in the amount of man-hours. Furthermore, there is a method for reducing the gaps by strongly winding electric wires, but strongly winding electric wires may destroy insulating coating of the electric wires in the corners of the rectangular bobbin. Thus, the present invention provides an amorphous core transformer in a simple configuration provided with a coil with reduced gaps between electric wires and a bobbin of the coil.

Regarding such a transformer, for a core transformer that uses a silicon steel plate or amorphous magnetic material as the material of the core and uses a wound core as the core structure, the above-described patent documents already disclose a technique of preventing the coil from deforming through buckling and pressing the wound core. The technique for such a core transformer disclosed in these patent documents is a measure taken for buckling of the coil itself and the patent documents give no description of the fact that the coils influence each other when there are a plurality of coils like a three-phase transformer and the coils vibrate due to an electromagnetic mechanical force at the time of short circuit.

However, in the case of a three-phase coil or the like, since there is a phase difference (e.g., 120 degrees) between coils, vibration of the coils also varies with time, and the coils are thus known to influence each other. It is therefore necessary to take into consideration the influences of an unpredicted force being applied to the windings of the coils due to the time difference or phase difference of vibration among the coils and an unpredicted force also being applied to the transformer itself. For example, neighboring coils normally function as stoppers to suppress displacement toward the outside of the coil, but the time difference of vibration eliminates the function and a gap may be produced between the inner coil and the outer coil. There is a problem that fluctuation, displacement or the like occurs as a result of the electromagnetic mechanical force applying to the coils.

The present invention has been implemented in view of the above-described problems and it is an object of the present invention to provide a transformer capable of effectively suppressing fluctuation, displacement or the like of coils caused by an electromagnetic mechanical force or the like.

SUMMARY OF THE INVENTION

In order to solve the above-described problems, an amorphous core transformer of the present invention is a transformer including an amorphous core, a plurality of coils in which the amorphous core is inserted and a fixing metal frame that arranges the coils adjacent to each other and assembles the coils and the amorphous core, wherein an inter-coil member is provided between the coils and the inter-coil member is positioned and fixed at a predetermined position using a positioning member.

Furthermore, in the amorphous core transformer of the present invention, a positioning section that engages the positioning member with the inter-coil member in concavo-convex engagement is formed to fix the positioning member for positioning the inter-coil member to the fixing metal frame.

Furthermore, in the amorphous core transformer of the present invention, one pair of the positioning members are arranged above and below or before and behind the amorphous core.

Furthermore, in the amorphous core transformer of the present invention, the fixing metal frame that assembles the amorphous core and the plurality of coils is provided with a pair of coil holding metal fittings that support both ends of the coil from both end sides.

An amorphous core transformer of the present invention is a transformer including an amorphous core, a plurality of substantially ellipsoidal coils in which the amorphous core is inserted and a fixing metal frame that arranges the coils adjacent to each other and assembles the coils and the amorphous core, wherein an inter-coil member having a concave curved part at the center is provided between the coils and the inter-coil member is positioned and fixed at a predetermined position using a positioning member.

The present invention arranges an inter-coil member between a plurality of neighboring coils for filling gaps between the coils, provides a positioning member that sandwiches the inter-coil member from above and below, or before and behind to position and hold the inter-coil member, and can thereby suppress displacement or fluctuation of the coils. That is, for example, three-phase coils are known to vibrate by an electromagnetic mechanical force at the time of short circuit in such a way that an inner coil and an outer coil constituting each coil repel each other in opposite directions of displacement. In the case of a three-phase coil or the like, this vibration of the coils varies with time because of a phase difference between the coils (e.g., 120 degrees), and therefore the coils also influence each other. For example, at a certain moment, one of the neighboring coils vibrates so that the outer coil displaces in the direction of the other coil through repulsion between the inner coil and the outer coil of the coil itself, but it is possible to suppress displacement or fluctuation of the coil through the inter-coil member interposed between the coils.

DETAILED DESCRIPTION OF THE PREFERRED EMBODIMENTS

Hereinafter, embodiments of the present invention will be described with reference to the accompanying drawings. In descriptions of the embodiments, forward, backward, leftward and rightward directions will be defined based on FIGS. 1 to 5. (X, Y and Z forward directions are defined as rightward, backward and upward directions respectively.)

Embodiment 1

Figure 1:
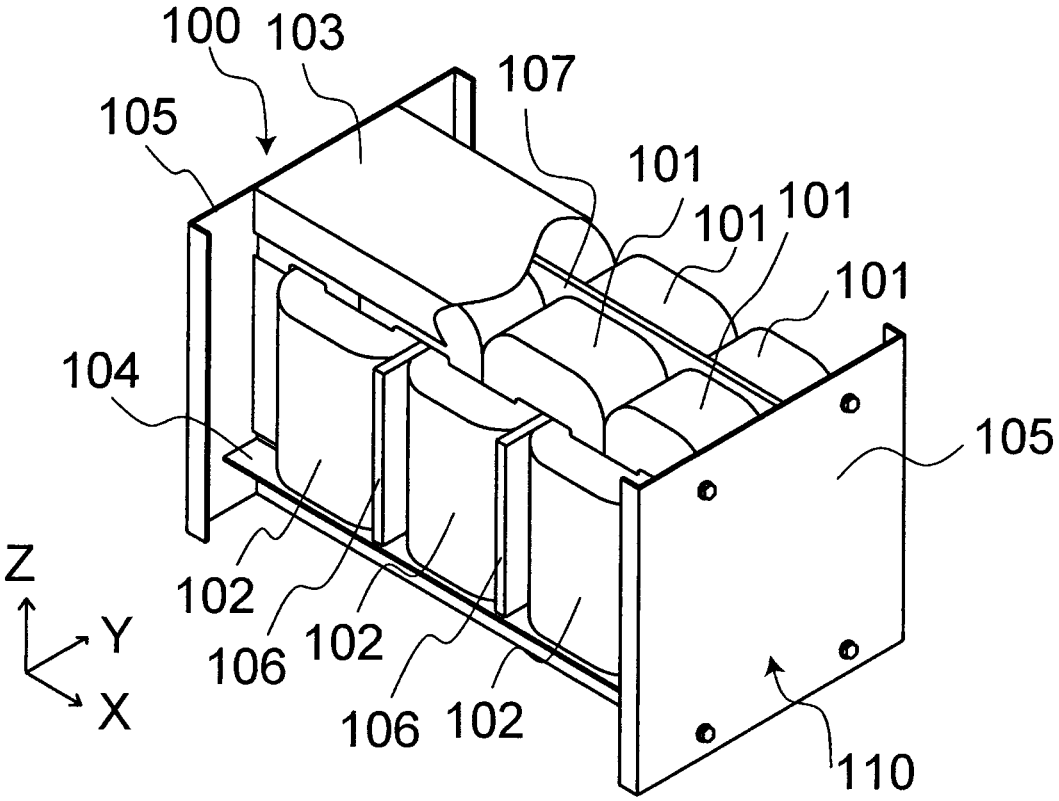
FIG. 1 is a schematic diagram illustrating a transformer showing Embodiment 1 of the present invention.

FIG. 1 is a schematic diagram illustrating a configuration of a transformer according to the present invention. As shown in FIG. 1, a transformer 100 of the present embodiment is constructed of amorphous cores 101, coils 102 inserted in the amorphous cores 101 so as to interlink with each other, and a fixing metal frame 110 that fixes these coils. The transformer 100 according to the present embodiment is a three-phase five-leg core transformer provided with three-phase coils 102 . . . and four amorphous cores 101 . . . (back side) and these three-phase coils 102 . . . and four amorphous cores 101 . . . (back side) are arranged adjacent to each other and assembled into the fixing metal frame 110.

The fixing metal frame 110 is constructed of an upper tightening metal fitting 103 that covers the top of the amorphous core 101, a lower tightening metal fitting 104 that supports the coils 102 and coil holding metal fittings 105 that support both sides of the coils 102, 102, and the upper tightening metal fitting 103, lower tightening metal fitting 104, coil holding metal fittings 105 are assembled into a frame to constitute the fixing metal frame 110. Furthermore, inter-coil members 106 that are positioned between a plurality of neighboring coils 102 . . . are arranged to fill gaps between the coils 102, and positioning members 107 that sandwich the inter-coil members 106 from above and below to position and hold the inter-coil members 106 are provided. These positioning members 107 are positioned above and below each coil 102 . . . and arranged between the front side amorphous core 101 . . . and the rear side amorphous core 101 . . . divided between the front and rear sides. The bottom side positioning member 107 is not shown in the figure.

Figure 2:
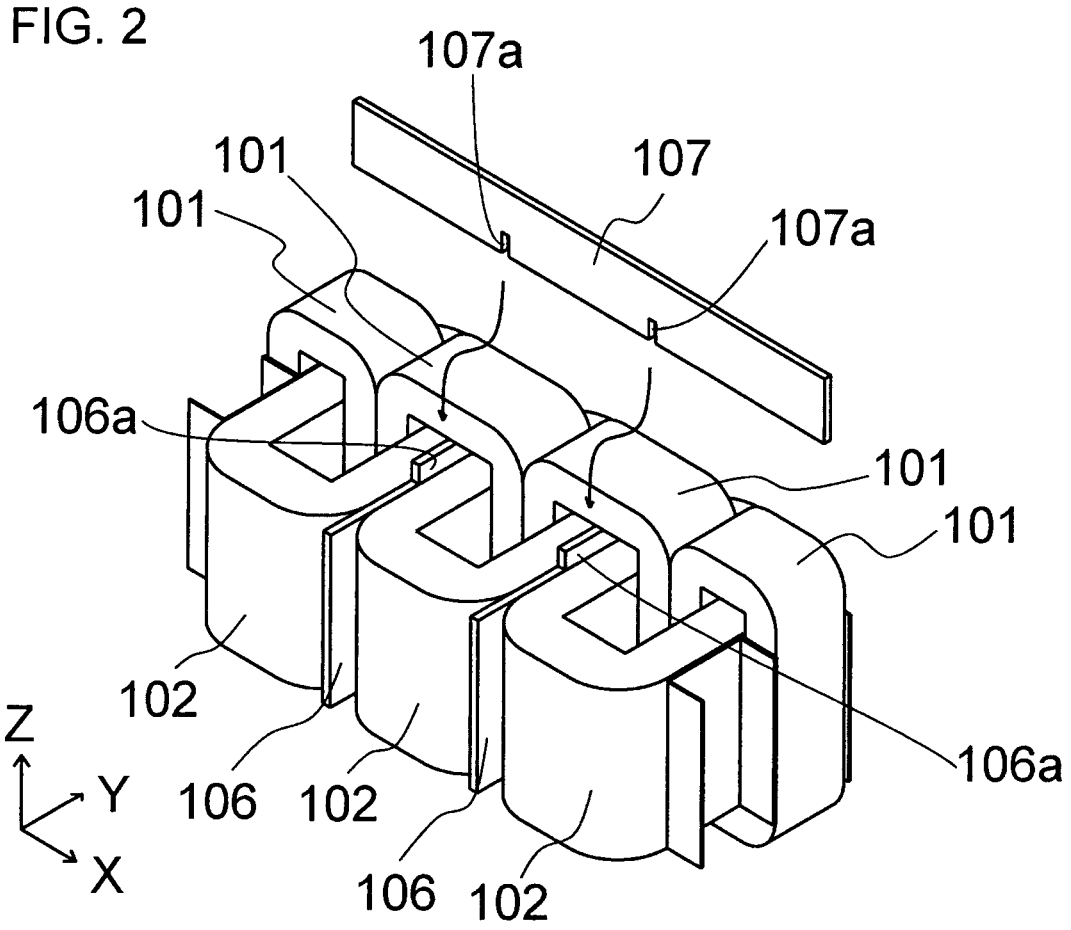
FIG. 2 is an exploded perspective view of a positioning member with the fixing metal frame omitted from the schematic diagram in FIG. 1.

FIG. 2 is a perspective view showing a mutual relationship between the shapes of the inter-coil members 106 and the positioning member 107 with the fixing metal frame 110 omitted from FIG. 1 in an easily understandable manner. The inter-coil members 106 interposed between the neighboring coils 102 have parts protruding from the upper and lower sides formed as positioning protrusions 106*a* (in FIG. 2, the positioning protrusion 106*a* of the lower side is not shown), and the positioning member 107 has positioning grooves 107*a* formed to position the positioning protrusions 106*a* at predetermined positions and the inter-coil members 106 are positioned and held by the upper and lower positioning members 107 by causing the positioning protrusions 106*a* to engage with the positioning grooves 107*a*.

That is, the length in the X direction of the upper and lower positioning members 107 is set to be equal to the length in the X direction of the upper tightening metal fitting 103 and the lower tightening metal fitting 104 in FIG. 1 and displacement in the X direction is regulated by the coil holding metal fittings 105 arranged on both sides of the upper tightening metal fitting 103 and the lower tightening metal fitting 104. In this way, the inter-coil members 106 positioned by the positioning member 107 have no displacement in the X direction within the fixing metal frame 110. Interposing the inter-coil members 106 positioned and held with respect to the fixing metal frame 110 between the neighboring coils 102 . . . in this way prevents the coils 102 from deforming or displacing beyond the inter-coil members 106 (that is, never deforming or displacing the neighboring coils), and can maintain the shapes of the coils 102 . . . . Furthermore, the coil holding metal fittings 105 are arranged on both sides of the coils 102, 102 positioned on both sides and these coil holding metal fittings 105 regulate displacement in the X direction.

Furthermore, regulating plates for holding coils are generally arranged so as to contact the top and bottom of each coil 102 . . . for the purpose of suppressing shifting of the coils 102 . . . in the axial direction (Z direction), filling the gaps between the amorphous cores 101 divided before and behind and suppressing deflection of the amorphous cores 101, and in the present embodiment, the positioning member 107 also functions as the regulating plate. That is, it is possible to add a function of fixing the inter-coil members 106 without losing the conventional function to the positioning member 107 available also for the purpose of suppressing shifts in the axial direction (Z direction) of the coils 102 . . . , filling the gaps between the amorphous cores 101 divided before and behind and suppressing deflection of the amorphous cores 101 by only forming the positioning grooves 107*a* to position the positioning protrusions 106*a* of the inter-coil members 106.

As described above, by interposing the inter-coil members 106 between the neighboring coils 102, 102 and holding the positions of the inter-coil members 106 at predetermined positions using the positioning member 107, it is possible to suppress displacement or fluctuation of the coils 102 using the positioning member 107.

Figure 6:
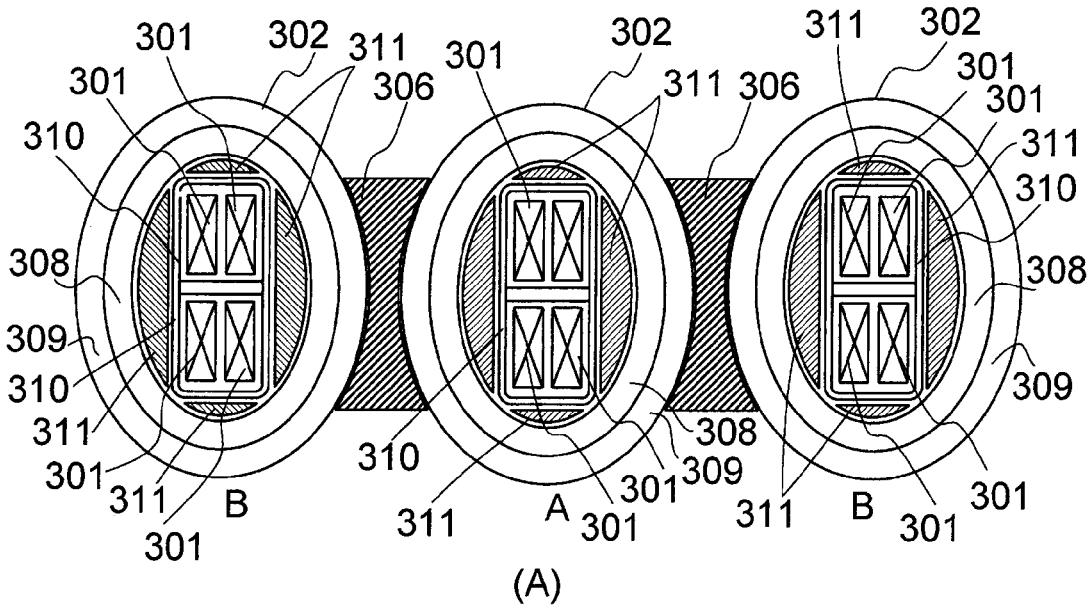
FIG. 6 is an enlarged cross-sectional view of a coil in each embodiment of the present invention.
Figure 6:
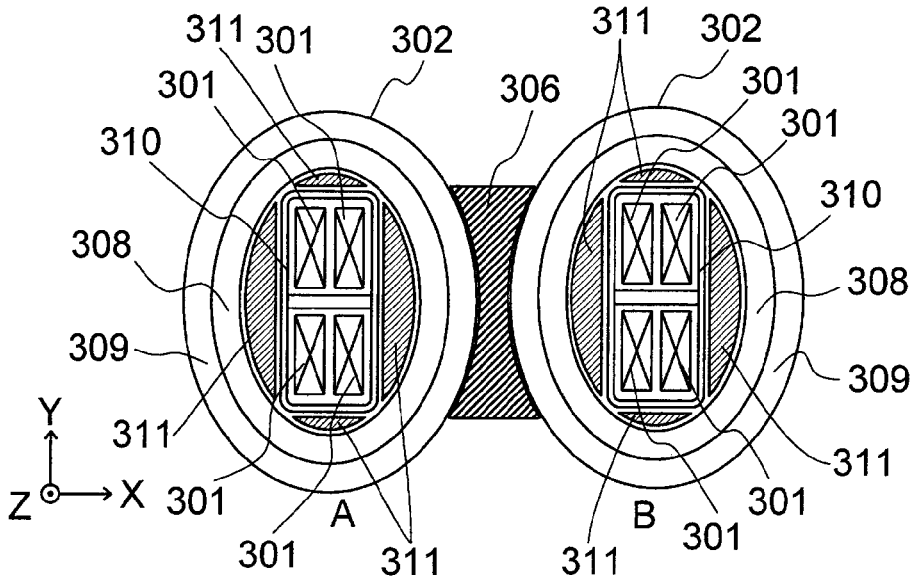
Figure 9:
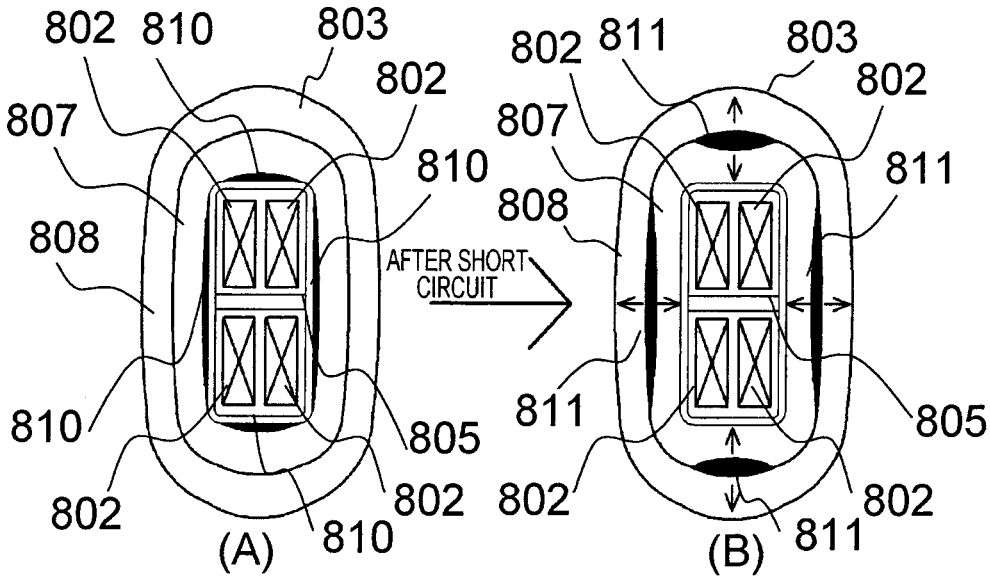
FIGS. 9(A) and (B) are cross-sectional views illustrating a coil shape of a conventional amorphous core transformer.

Here, an enlarged cross-sectional configuration of the coil in each embodiment of the present invention will be described. That is, a three-phase coil 302 . . . of each embodiment of the present invention is constructed of an inner coil 308 and an outer coil 309 as shown in FIGS. 6(A) and (B), and the inner coil 308 and the outer coil 309 constituting the coil 302 are generally known to repel each other in directions opposite to their respective displacement directions by an electromagnetic mechanical force at the time of short circuit (FIG. 9(B)). In the case of a three-phase coil or the like, this vibration of the coil 302 varies with time due to a phase difference (e.g., 120 degrees) between the coils, and therefore the neighboring coils influence each other. For example, at a certain moment, the coil 302 A vibrates so that the outer coil 309 displaces toward the direction of coil 302 B due to repulsion between the inner coil 308 and the outer coil 309 of the coil 302 A itself, but at the next moment, the coil 302 B vibrates so that the outer coil 309 displaces toward the direction of the coil 302 A due to repulsion between the inner coil 308 and the outer coil 309 of the coil 302 B itself. Therefore, unless the inter-coil member 306 interposed between the coils 302 are firmly fixed without any gap, the inter-coil member 106 will displace in accordance with the vibration of the outer coil 309. However, as opposed to this, the present invention reliably positions and holds the inter-coil members 106 using the positioning member 107, and can thereby realize the function of suppressing displacement or fluctuation of the coils 102 in a simple configuration.

The positioning member 107 and the inter-coil members 106 need to be made of materials strong enough to withstand the electromagnetic mechanical force at the time of short circuit. It is also necessary to consider insulating properties and, for example, members having insulating properties such as veneer plate, epoxy plate are preferably used, but a steel plate having high mechanical strength can also be used and be effective as long as reliable insulating measures are applied. Furthermore, the inter-coil member 106 can have a flat plate shape, but by forming an inter-coil member 306 having a concave curved section at the center in accordance with the outside shape of the neighboring substantially ellipsoidal coil 302 as shown in FIGS. 6(A) and (B), it is possible to increase the area of contact between the coil 302 and the inter-coil member 306 and thereby effectively suppress deformation or fluctuation of the coil 302.

Furthermore, in each embodiment of the present invention, as shown in the enlarged cross-sectional views in FIGS. 6(A) and (B), the coil 302 is constructed of the inner coil 308 and the outer coil 309 wound around the rectangular bobbin 310 where four cores 301 are disposed, and in this case, four fan-shaped spacers 311 are arranged on both sides, before and behind, and to the left and right of the rectangular bobbin 310 to reduce the sizes of the gaps produced between the inner coil 308 and the rectangular bobbin 310. This causes the angle formed between the first row of the inner coil 308 and the area of the rectangular bobbin 310 that comes in contact therewith to become less acute with the spacer 311 serving as a guide in the corners of the rectangular bobbin 310. Furthermore, the shape of the spacer 311 is not limited to the fan shape, but may also be rectangular, trapezoidal, stepped or the like as long as it is the shape that can reduce the space between the rectangular bobbin 310 and the inner coil 308. Furthermore, to reduce a temperature increase of the coil 302, a plurality of cooling ducts 509 may be provided inside the coil 302 in accordance with a temperature rise of the coil. Adopting a shape, not a rectangular but substantially ellipsoidal shape for the coil in such a winding configuration can produce the effect of preventing gaps from being generated between the coil and the bobbin.

Thus, the intervention of the spacer 311 between the rectangular bobbin 310 and the coil 302 provides a structure in which there is no gap between the inner coil 308 and the rectangular bobbin 310 even in the presence of a repulsive force acting between the inner coil 308 and the outer coil 309 due to the electromagnetic mechanical force at the time of short circuit, and therefore there is no space into which the inner coil 308 drops, and it is thereby possible to reduce a short circuit impedance variation after short circuit or a deterioration rate of no load loss.

The coil can also be formed into a substantially ellipsoidal shape by arranging a plurality of cooling ducts inside the coil instead of the embodiment shown in FIGS. 6(A) and (B). Here, several other methods for forming the coil into a substantially ellipsoidal shape will be described.

Figure 7:
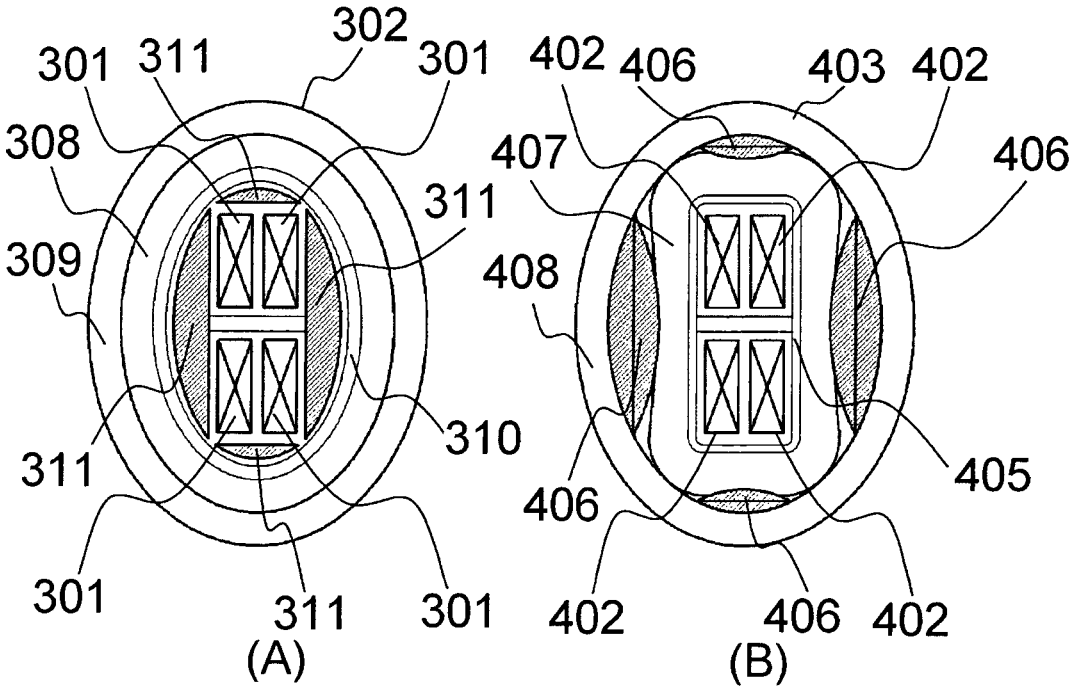
FIGS. 7(A) and (B) are diagrams illustrating another method of forming a coil into a substantially ellipsoidal shape.

The method shown in FIG. 7(A), which is a cross-sectional view of the coil 302 of the amorphous core transformer, provides a cylindrical bobbin 310 outside the amorphous core 301, and winds the cylindrical bobbin 310 with the inner coil 308 and the outer coil 309. The fan-shaped spacer 311 is provided between the rectangular amorphous core 301 and the cylindrical bobbin 310, and the coil 302 having a circular cross section is formed.

The method shown in FIG. 7(B), which is a cross-sectional view of a coil 403 of an amorphous core transformer, provides a rectangular bobbin 405 outside the amorphous core 402, and winds the rectangular bobbin 405 with an inner coil 407 and an outer coil 408. Two fan-shaped spacers 406 are pasted together for each location and provided between the inner coil 407 and the outer coil 408 to form the coil 403 having a circular cross section.

Figure 8:
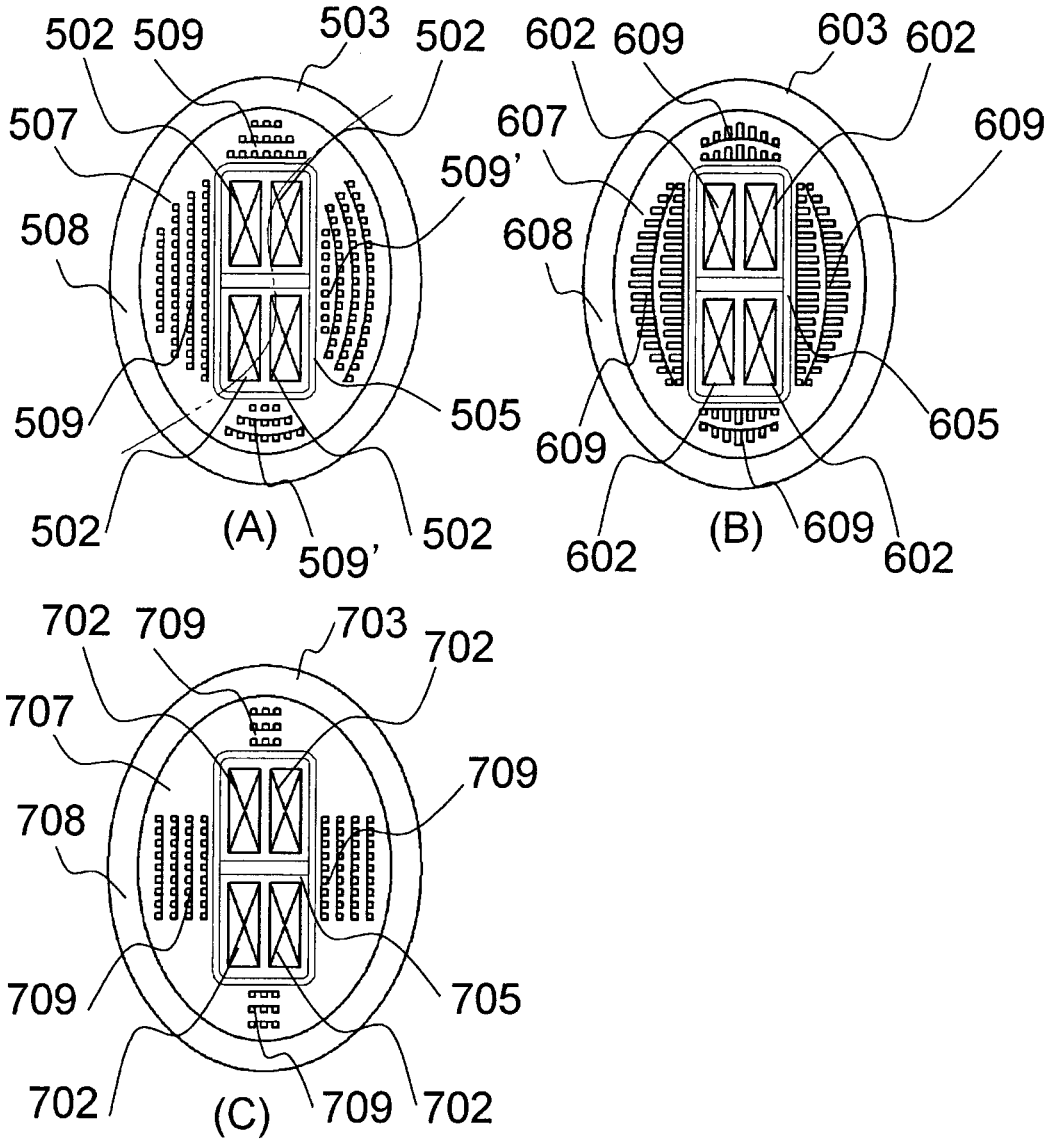
FIGS. 8(A), (B) and (C) are diagrams illustrating a further method of forming a coil into a substantially ellipsoidal shape.

The method shown in FIG. 8(A), which is a cross-sectional view of a coil 503 of an amorphous core transformer according to the present invention provides a rectangular bobbin 505 outside the amorphous core 502 and winds the rectangular bobbin 505 with an inner coil 507 and an outer coil 508. To alleviate a temperature rise, the coil 503 is normally provided with a number of cooling ducts 509 corresponding to the temperature rise of the coil. In the present embodiment, regarding the insertion section of the cooling ducts 509 provided in the inner coil 507, the cooling duct section provided outside is set to be equal to or shorter than the cooling duct section provided inside to form the coil 503 having a circular cross section. Alternatively, regarding the insertion section of cooling ducts 509' provided in the inner coil 507, the cooling duct section provided outside is set to be equal to or longer than the cooling duct section provided inside to form the coil 503 having a circular cross section.

The method shown in FIG. 8(B), which is a cross-sectional view of a coil 603 of an amorphous core transformer according to the present invention provides a rectangular bobbin 605 outside an amorphous core 602 and winds the rectangular bobbin 605 with an inner coil 607 and an outer coil 608. In the present embodiment, regarding the width of the cooling duct 609 provided in the inner coil 607, the width of cooling ducts provided in the center of the rectilinear part is set to be equal to or greater than the width of the cooling ducts provided at both ends to form the coil 603 having a circular cross section.

The method shown in FIG. 8(C), which is a cross-sectional view of a coil 703 of the amorphous core transformer according to the present invention provides a rectangular bobbin 705 outside an amorphous core 702 and winds the rectangular bobbin 705 with an inner coil 707 and an outer coil 708. In the present embodiment, cooling ducts 709 provided in the inner coil 707 are provided only in the center of a rectilinear part to thereby form the coil 703 having a circular cross section.

Embodiment 2

Figure 3:
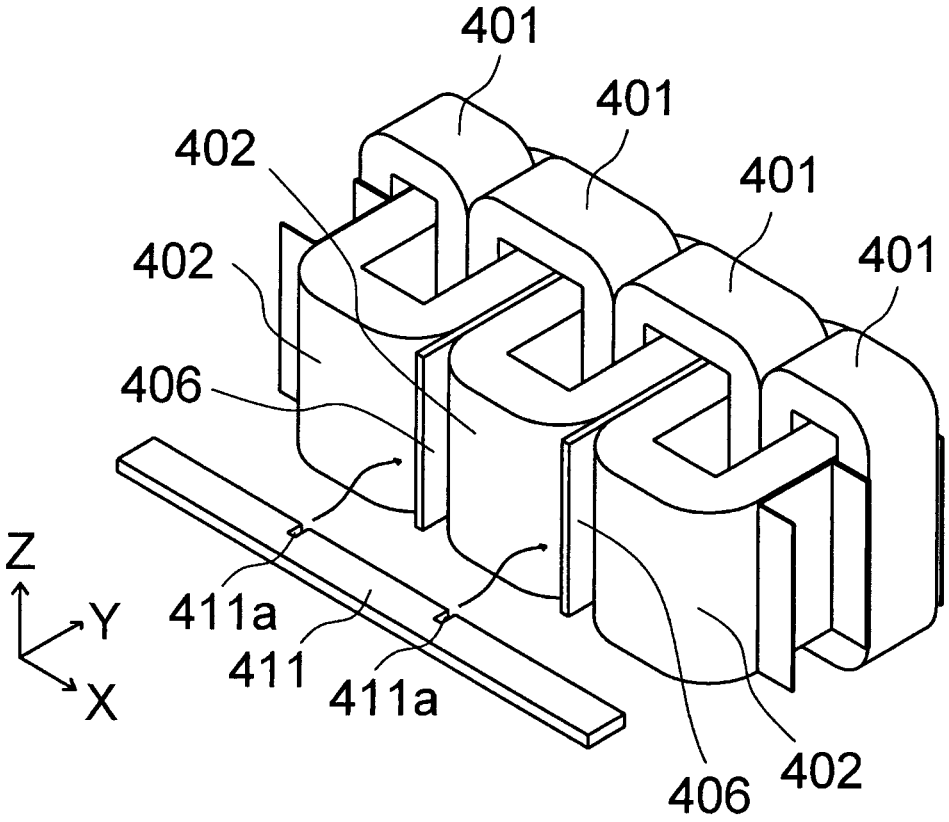
FIG. 3 is an exploded perspective view of a positioning member showing Embodiment 2 of the present invention with its fixing metal frame omitted.

FIG. 3 is a schematic diagram illustrating a configuration of a transformer according to Embodiment 2 of the present invention. A case has been described in above Embodiment 1 where the inter-coil members 106 that suppress deformation or displacement of the coils 102 are positioned and held by sandwiching the inter-coil members 106 by the positioning members 107 from above and below. In present Embodiment 2, positioning members 411 are provided before and behind coils 402. That is, in Embodiment 1, the regulating plate for the purpose of suppressing shifts in the axial direction (Z direction) of the coils 102 . . . , filling the gaps between the amorphous cores 101 divided before and behind and suppressing deflection of the amorphous cores 101 is used as the positioning member 107, but there may also be a transformer having a configuration without any such regulating plate. In such a transformer, coil holding members 411 are arranged before and behind the coils 402, inter-coil members 406 arranged between the coils 402 are engaged with positioning grooves 411*a* formed in the coil holding members 411 to position and hold the inter-coil members 106. In this way, as in the case of above Embodiment 1, the positioning members 411 can suppress displacement or fluctuation of the coils 402. In FIG. 3, reference numeral 401 denotes an amorphous core.

Embodiment 3

Figure 4:
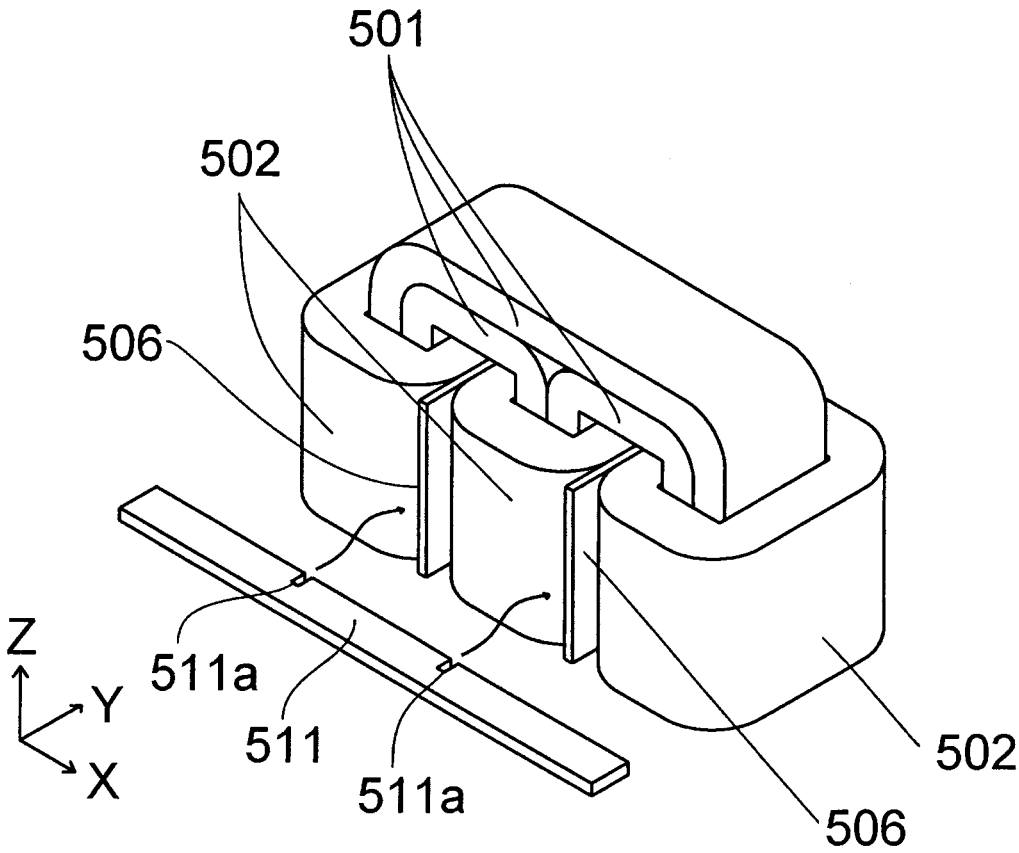
FIG. 4 is a schematic diagram illustrating a transformer showing Embodiment 3 of the present invention.

Furthermore, the transformer configuration is not limited to the three-phase five-leg core transformer provided with three coils and four amorphous cores, but may be a three-phase three-leg core transformer provided with three coils 502 . . . and three amorphous cores 501 . . . as Embodiment 3 of the present invention shown in FIG. 4. Furthermore, the positioning structure of inter-coil members in Embodiment 3 shown in FIG. 4, as in the case of Embodiment 2 in FIG. 3, coil holding members 511 are arranged before and behind the coils 502, inter-coil members 506 are engaged with positioning grooves 511*a* formed in the coil holding members 511 to position/hold the inter-coil members 506.

Embodiment 4

Figure 5:
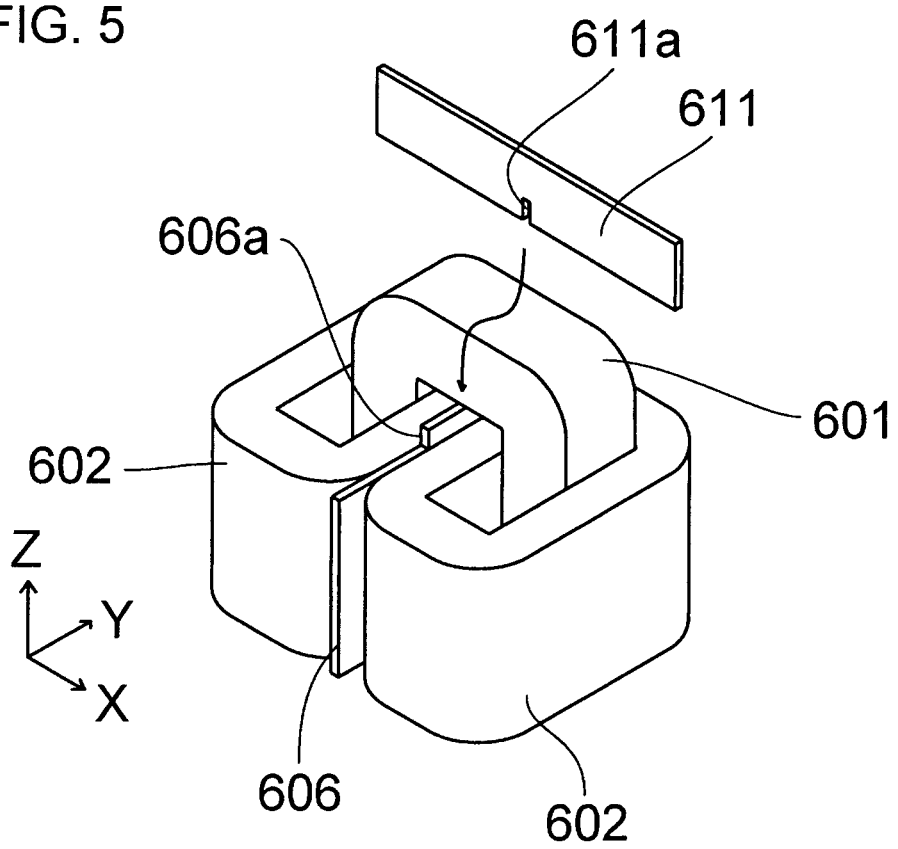
FIG. 5 is a schematic diagram illustrating a transformer showing Embodiment 4 of the present invention.

Furthermore, a single-phase transformer provided with two coils 602 and one amorphous core 601 . . . may also be adopted as Embodiment 4 of the present invention shown in FIG. 5. Furthermore, the positioning structure of an inter-coil member according to Embodiment 4 of the present invention shown in FIG. 5 is the same configuration as that of Embodiment 1 shown in FIG. 2. That is, coil holding members 611 are arranged above and below the coils 602, a positioning protrusion 606*a* formed in the inter-coil member 606 is engaged with a positioning groove 611*a* formed in this coil holding member 611 to position/hold the inter-coil member 606.

The embodiments of the present invention have been described in detail, but the present invention is not limited to the above-described embodiments and can be modified in various ways without departing from the spirit and scope of the present invention. For example, the entire configuration including the spacer and cooling ducts or the like shown in Embodiment 1 need not be provided. Furthermore, although a case has been described as an example where a notch-like positioning groove that engages with the inter-coil member is provided in the positioning member as the positioning section of the inter-coil member, a structure using elasticity such as a hook or a structure having an inter-coil member engaged between a pair of rails or the like may be selected as appropriate. Furthermore, part of the configuration of Embodiment 1 may be substituted by the configuration of Embodiment 2 or a configuration of another embodiment may be added to a configuration of a certain embodiment or part of a configuration may be added, substituted or deleted.

What is claimed is:

1. An amorphous core transformer comprising:

an amorphous core;

a plurality of coils in which the amorphous core is inserted;

a fixing metal frame that arranges the coils adjacent to each other and assembles the coils and the amorphous core;

a plate-shaped inter-coil member which is interposed between the adjacent coils; and a positioning member which has a plane spreading in a direction in which the plurality of coils are aligned, and which fixes the plurality of coils in an axial direction, wherein the fixing metal frame comprises a plate-like member which is arranged so as to be along an outer circumference surface of a coil among the plurality of coils that is arranged on an outer circumference side, and which has a plane spreading in a direction substantially parallel to the plate-shaped inter-coil member, the positioning member is formed with a notch-like positioning groove, and the inter-coil member is fixed so as not to move in the direction in which the plurality of coils are aligned by engaging with the notch-like positioning groove, the positioning member is spread in a direction substantially perpendicular to the fixing metal frame and is fixed in a state directly contacting the fixing metal frame, and the positioning member is spread in a direction substantially perpendicular to a plurality of the inter-coil members, and the positioning member and the plurality of the inter-coil members are fixed to each other in concavo-convex engagement.

2. The amorphous core transformer according to claim 1, wherein one pair of the positioning members are arranged above and below or before and behind the amorphous core.

3. An amorphous core transformer comprising:

an amorphous core;

a plurality of substantially ellipsoidal coils in which the amorphous core is inserted;

a fixing metal frame that arranges the coils adjacent to each other and assembles the coils and the amorphous core;

an inter-coil member which has a shape that conforms to an outside shape of the substantially ellipsoidal coils and which is provided between the coils; and a positioning member which has a plane spreading in a direction in which the plurality of coils are aligned, and which fixes the plurality of coils in an axial direction, and wherein the fixing metal frame comprises a member which is arranged on an outer circumference side of the coil among the plurality of coils that is arranged on an outer circumference side, the positioning member is formed with a notch-like positioning groove, and the inter-coil member is fixed so as not to move in the direction in which the plurality of coils are aligned by engaging with the notch-like positioning groove, the positioning member is spread in a direction substantially perpendicular to the fixing metal frame and is fixed in a state directly contacting the fixing metal frame, and the positioning member is spread in a direction substantially perpendicular to a plurality of the inter-coil members, and the positioning member and the plurality of the inter-coil members are fixed to each other in concavo-convex engagement.

4. The amorphous core transformer according to claim 3, wherein a spacer is provided between the amorphous core and the coil, and the spacer is provided with a cooling duct.

5. The amorphous core transformer according to claim 4, wherein the spacer is provided inside the bobbin and the electric wires of the inner coil and the outer coil are wound outside the bobbin.

6. The amorphous core transformer according to claim 4, wherein in an insertion section of the cooling duct interposed between the coils, a cooling duct section provided outside is set to a distance equal to or shorter than a cooling duct section provided inside and the coil winding is configured to have a substantially ellipsoidal cross section.

7. The amorphous core transformer according to claim 4, wherein in an insertion section of the cooling duct interposed between the coils, a cooling duct section provided outside is set to a distance equal to or greater than a cooling duct section provided inside, the outside duct is arranged in a fan shape and the coil winding is configured to have a substantially ellipsoidal cross section.

* * * * *